US005828390A

United States Patent [19]

Thiel

[11] Patent Number: 5,828,390

[45] Date of Patent: Oct. 27, 1998

[54] INK JET PRINT HEAD

[75] Inventor: Wolfgang Thiel, Berlin, Germany

[73] Assignee: Francotyp-Postalia AG & Co., Birkenwerder, Germany

[21] Appl. No.: 393,933

[22] Filed: Feb. 21, 1995

[30] Foreign Application Priority Data

Mar. 10, 1994 [DE] Germany ..... 94 04 328 U

[51] Int. Cl.[6] ..... B41J 2/145; B41J 2/045

[52] U.S. Cl. ..... 347/40; 347/71

[58] Field of Search ..... 347/71, 40, 42, 347/68, 94, 20, 54, 70

[56] References Cited

U.S. PATENT DOCUMENTS

| | | | |
|---|---|---|---|
| 3,988,745 | 10/1976 | Sultan | 347/71 |
| 4,367,480 | 1/1983 | Kotoh | 347/71 |
| 4,525,728 | 6/1985 | Koto . | |
| 4,591,883 | 5/1986 | Isayama . | |
| 5,028,514 | 7/1991 | Johannesen . | |
| 5,592,203 | 1/1997 | Thiel et al. | 347/40 |

FOREIGN PATENT DOCUMENTS

| | | |
|---|---|---|
| OS 26 49 970 | 5/1978 | Germany . |
| OS 36 08 205 | 9/1987 | Germany . |
| OS 36 09 154 | 9/1987 | Germany . |

OTHER PUBLICATIONS

"Print Engine Design Utilizing Impluse Ink Jet," Werning, First Annual Ink Jet Printing Workshop, Mar. 25–27, 1992, Cambridge, Massachusetts.

*Primary Examiner*—David F. Yockey
*Attorney, Agent, or Firm*—Hill & Simpson

[57] ABSTRACT

An ink jet print head has a middle part or plate sandwiched between two outer plates, with the middle plate being the only structured or profiled plate. The middle plate has different structures on its two opposite surfaces respectively facing the outer plates. Each of the different structures has recesses forming a group of non-concentric ink chambers. The ink chambers of each of these different structures are respectively spaced from one another in the x, y and z directions. Nozzle channels leading to a single nozzle row are fashioned on one of the two surfaces of the middle part. The ink chambers of one of the groups are directly connected to the nozzles by respective nozzle channels while the ink chambers of the other group are connected to the nozzles by respective nozzle channels and by respective channels extending through the middle part.

9 Claims, 5 Drawing Sheets

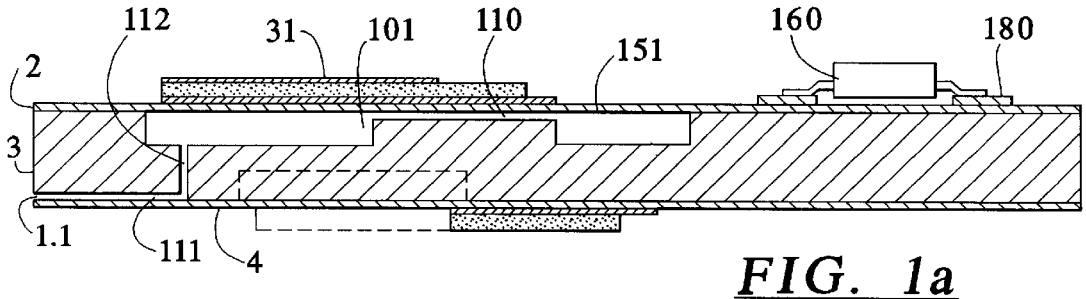
FIG. 1a
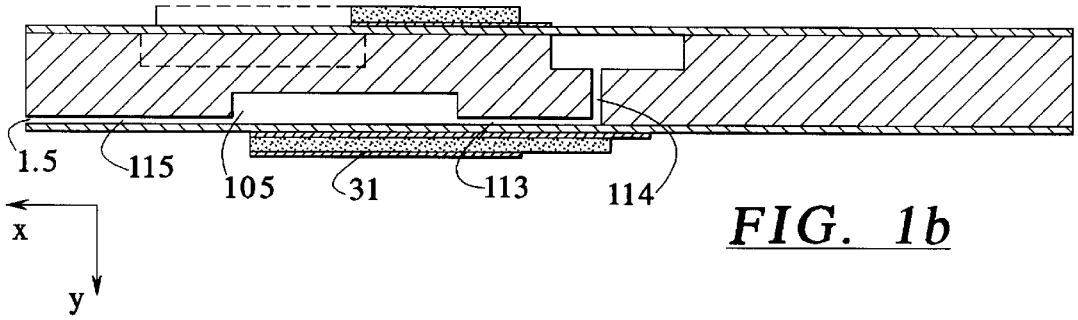
FIG. 1b
FIG. 1c
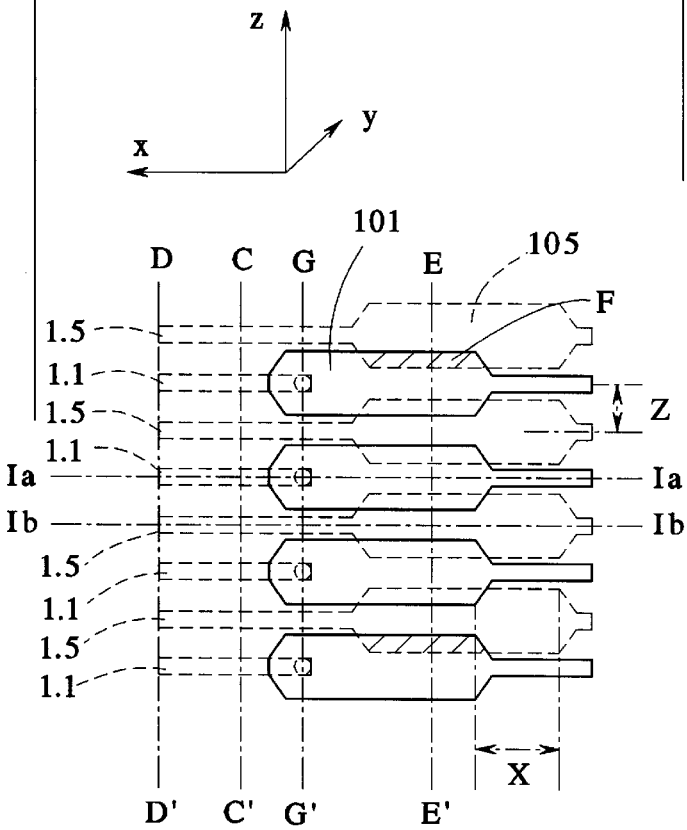
FIG. 1d
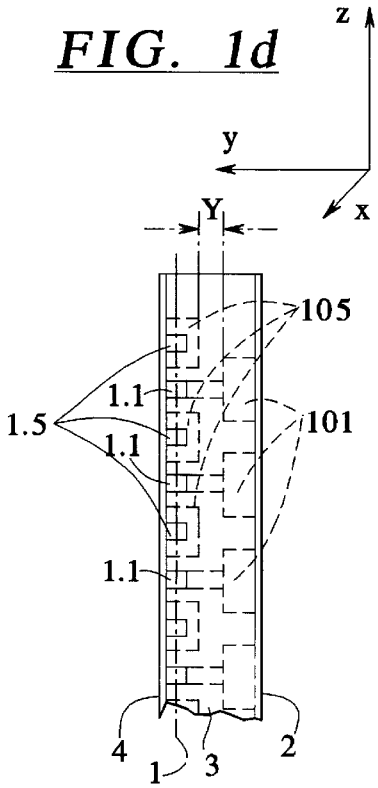

FIG. 4a
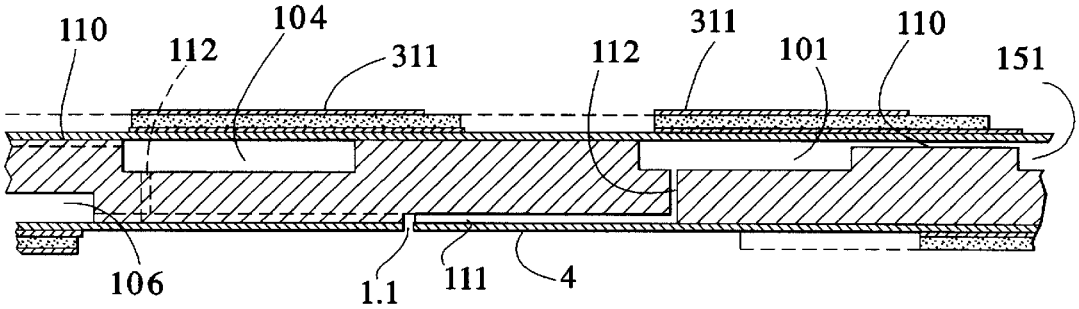
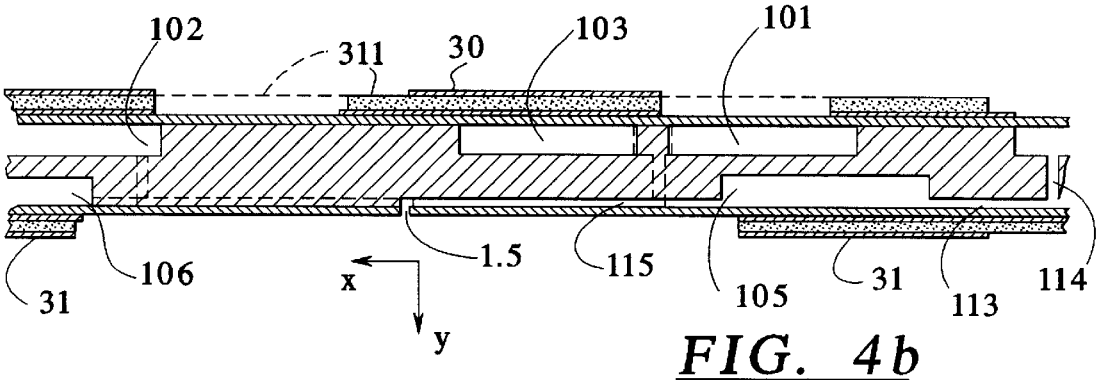
FIG. 4b
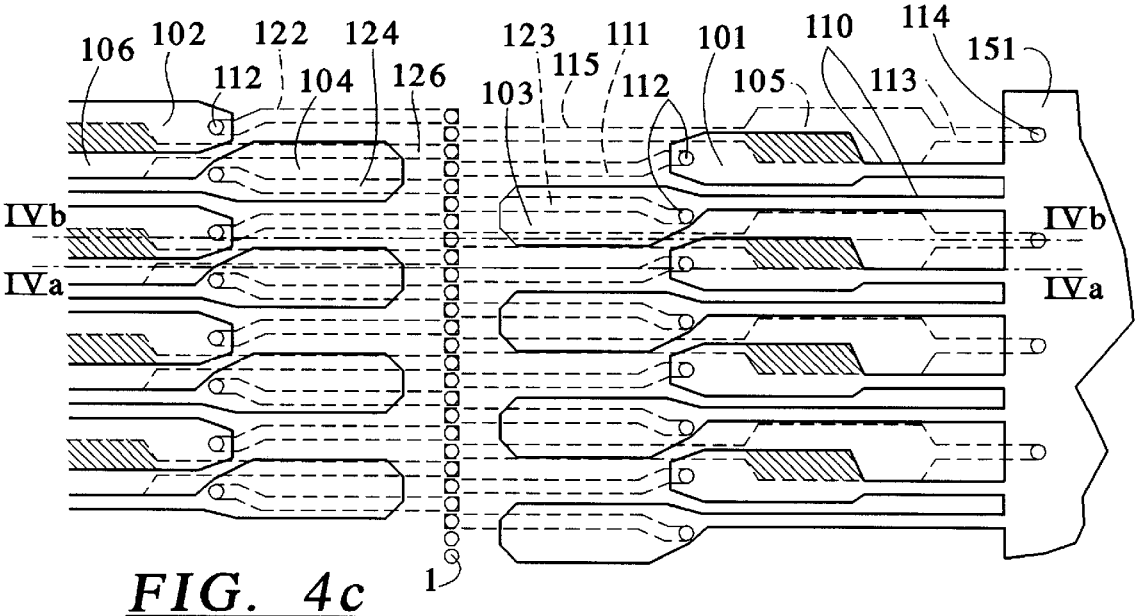
FIG. 4c

INK JET PRINT HEAD

BACKGROUND OF THE INVENTION

1. Field of the Invention

The present invention is directed to an ink jet print head of the type having a middle part or plate sandwiched between two outer parts or plates, with the structure necessary to form the nozzles, ink channels and ink chambers being produced by structuring these parts using photolithographic and etching processes.

2. Description of the Prior Art

Ink jet print heads of the above type can be utilized in fast printers as employed, for example, in postage meter machines for franking postal mailings. Such printing mechanisms must also fulfill the object of executing a complete print in only one motion phase, which requires a correspondingly large printing width of, for example, one inch.

It is known that ink jet print heads are constructed according to the edge-shooter or according to the face-shooter principle (First Annual Ink Jet Printing Workshop, Mar. 26–27, 1992, Royal Sonesta Hotel, Cambridge, Mass.). Previous attempts have been made to minimize the dimensions of the chambers in order to increase the jet density. These measures, however, are only meaningful given ink jet modules having a few jets in one row and fail given a high number of nozzles. An enhancement of the nozzle density must therefore be achieved in some other way.

German OS 36 08 205 and German OS 36 09 154 disclose a nozzle plate centrally arranged between two mirror-symmetrical print head halves, the required nozzle channels being simultaneously etched on the two plate surfaces of the nozzle plate so that they have an identical size. Two nozzle rows which are offset relative to one another arise as a result, however, this offset presumes an exact mask alignment in the lithographic process. The head assembly also requires an exact alignment of all plates stacked on top of one another. A further disadvantage is the relatively long ink path from the chambers to the nozzles.

German OS 38 14 720, corresponding to U.S. P. No. 5,028,514, discloses a print head constructed of an etched base plate and outer membrane plates. The base member has two nozzle rows. The nozzle rows lying offset relative to one another on both plate surfaces are simultaneously produced. The base member is exposed on two sides through masks adjusted exactly relative to one another and both sides are simultaneously etched thereafter. The use of a base member in fact avoids a complicated assembly of a number of plates on top of one another; however, the offset of the two nozzle rows relative to one another is still dependent on an alignment of the masks before the lithographic process. In this known structure, moreover, a relatively long ink path from the chamber up to the nozzle is required at each side of the base plate.

According to German OS 26 49 970, a jet printer for an ink printer constructed in sandwich fashion is composed of print head halves arranged mirror-symmetrically relative to one another. The ink chambers (compression chambers) are arranged lying opposite one another in pairs and are located in the outer structural plates of the print head halves. The brief-duration increases in pressure in these ink chambers are generated by a membrane arranged thereover and equipped with a piezo-ceramic resonator (PZT element). A nozzle plate having a compensation chamber is arranged between the print head halves such that it lies between the ink chambers. The cross-talk effect between channels can thus be effectively suppressed; however, a number of plates is required which must be exactly adjusted (aligned) relative to one another.

In order to achieve a high imaging density, corresponding to U.S. Pat. No. 5,592,203, proposes that a plurality of chambers be arranged offset horizontally and vertically relative to one another. A single nozzle row for the entire module is fashioned in a part carrying chambers. The high nozzle density in the nozzle row results from a multi-level structure. Ink channels that have a cross-section that is insensitive to tolerances extend through a number of levels. Nonetheless, this print head still requires that care be taken to align all components during manufacture. Again, the channels leading to the nozzles from the lower level, which is at a greater distance therefrom, are longer than those channels from the upper level, this leads to a phase shift of individual ink jets that must be electronically compensated. As a result of extremely long channels, higher forces must be exerted by the piezo-crystals, so that these are more likely to fail than the piezo-crystals used for the chambers connected to shorter channels. A further disadvantage of this arrangement is that each of the plates (at least three of which are required) must be structured in a different way. Each manufacturing step, lithography process, mechanical working and etching process must therefore be differently conducted for each of the three plates. This means that three different masks are required and the production sequence must start with three different wafers.

U.S. Pat. No. 4,525,728 discloses an edge-shooter ink jet printer module having one respective nozzle row per chamber plate. The dimensions of the chambers and channels can be further reduced under certain circumstances. The longitudinal axes of the relatively long ink chambers lie in the direction of the ink jet, whereas the width of the ink chambers is extremely reduced. A problem, however, arises in the manufacturing step of applying the PZT elements, since the tolerances to be observed are extremely tight.

SUMMARY OF THE INVENTION

An object of the present invention is to provide a compact ink jet print head for high-resolution printing which does not exhibit the disadvantages of the prior art and which can be manufactured in a simple way.

For achieving the above object, a simpler design was developed for an ink jet print head, whereby the number of manufacturing steps is reduced. In a version of the invention, only a middle plate is structured, whereas the two outer plates remain unstructured and are only joined for diffusion bonding to the middle plate. This becomes possible because the upper side of the middle plate is given a first structure and the underside is likewise lent a second, different structure, and the two structures are connected to one another by vertically proceeding, through-channels which are etched proceeding from only one side of the middle plate. The two structures form chamber groups that are spaced from one another in the x, y and z directions.

Beneath a first plane wherein a first group of ink chambers lies in the middle part, a spacing Y is produced by a second plane and a further group of ink chambers is then arranged in a third plane, beneath the second plane, such that the ink chambers of the third plane have a vertical spacing Y from those of the first plane as well as a horizontal offset X relative to the nozzle line. The different ink path lengths caused by the vertical spacing in the y-direction perpendicular to the planes is thus compensated by a defining channel length within the planes.

The chambers are arranged relative to the nozzle row, as well as relative to an intake space, so that ink channels, particularly horizontal nozzle channels and/or admission channels and/or vertical through-channels, of different lengths are provided in parallel planes within the middle part, with a sum of the ink channel lengths being approximately constant per chamber.

The nozzle channels leading to the single nozzle row are arranged on one of the two surfaces of the middle part and are preferably realized in one etching process. Proceeding from the surface having the nozzle channels, further vertical, ink through-channels are worked through the third and second plane. These are produced by removing plate material proceeding from the other surface to a depth where the second plane begins. The ink chambers can be disposed at the intake region of each channel and are thus worked into the respective vertical ink through-channel.

A significant further advantage of the invention is thereby achieved, which is an insensitivity to the effect of tolerances (tolerance build-up) due to the design of the invention, because the individual planes of the multi-level structure are not realized in individual plates that must be arranged offset relative to one another. The masks required before the lithographic process can also be positioned within a certain tolerance relative to one another, since the connecting channels must meet only at the relatively large base of the chamber floor for a particular channel.

The invention permits a higher number of nozzles in a row, with a relatively short ink channel length, on the basis of the inventive solution of having ink chambers that are arranged horizontally and vertically offset, for example for an edge-shooter ink jet in-line (ESIJIL) print head. A characteristic of the ESIJIL print head is that a nozzle arrangement is provided for an ink ejection in the x-direction in the third plane of the middle part that contains the nozzle channels, and the nozzles belonging to different nozzle groups alternate in the nozzle row. In a first version, each surface of the middle part carries a chamber group. In a second version, one surface carries the nozzle channels and a chamber group and the other surface carries two chamber groups, i.e. that the different structure on one of the two surfaces of the middle part includes a chamber group in addition to the first chamber group that is arranged offset in the x-direction and the z-direction relative to the first chamber group. Nozzles that belong to different nozzle groups alternate in a single nozzle row and coincidence (overlapping) of chambers of the chamber group of the one plane with those of the other plane is avoided, or only occurs at the edges of the chambers. The cross-talk effect is thereby effectively minimized.

Another embodiment of the ink jet print head having a number of planes arranged in the y-direction is directed to a face-shooter ink jet in-line (FSIJIL) print head and likewise has different structures on both surfaces of a middle part that are spaced from one another in the x, y and z directions, so that overlapping of the ink chambers occur only at the chamber edges. It is a characteristic of the FSIJIL print head that a nozzle arrangement for ink ejection in the y-direction is provided in a membrane plate in a third plane of the middle part that contains the nozzle channels, and the nozzles belonging to different nozzle groups alternate in the nozzle row. A single nozzle row that proceeds in the z-direction, and to which nozzle channels lead from two sides, is thus fashioned on one of the two surfaces of the middle part and on the adjoining membrane plate. In one version, each surface of the middle part has only one chamber group. In another version, the one surface of the middle part has two chamber groups. In this version the different structures respectively provided on the opposite surfaces include a first structure having chamber groups in first and third planes of the middle part which are spaced from one another in the x, y and z directions, and a second different structure in the first plane of the middle part includes additional chamber groups that are spaced from one another in the x and z directions. The middle part is provided with vertical and horizontal ink channels, so that relatively short ink paths which, however, are of equal length arise from the respective chambers to the nozzles. The arrangement allows an increased range of tolerances in the positioning of the masks in the photolithographic structuring of the middle plate, and thus a higher yield of functional print heads. The nozzle openings are worked into the membrane plate by etching or by laser beam processing.

After the etching of the middle plate and the manufacture of membrane plates by parallel processing of glass plates including the formation of a defined thickness by etching and fine-grinding, separating and joining of the discrete parts to form a module that is provided with interconnects and PZT elements ensues.

DESCRIPTION OF THE DRAWINGS

FIG. 1*a* is a section of a first embodiment of an ESIJIL print head constructed in accordance with the principles of the present invention, taken along line Ia—Ia of FIG. 1*c*.

FIG 1*b* is a section of the firs embodiment of an ESIJIL print head constructed in accordance with the principles of the present invention, taken along the line Ib—Ib of FIG. 1*c*.

FIG. 1*c* is a plan view onto the middle plate (equipping side) showing the position of the chambers in the first embodiment of an ESIJIL print head constructed in accordance with the principles of the present invention.

FIG. 1*d* is a view of the nozzle side showing the nozzle line of the first embodiment of an ESIJIL print head constructed in accordance with the principles of the present invention.

FIG. 4*a* is a section of the right half of a second embodiment of an FSIJIL print head constructed in accordance with the principles of the present invention, taken along line IV—IV of FIG. 4*c*.

FIG. 4*b* is a section of the right half of the second embodiment of an FSIJIL print head constructed in accordance with the principles of the present invention, taken along line IVb—IVb of FIG. 4*c*.

FIG. 4*c* is a plan view onto the middle plate (equipping side) showing the position of the chambers in the second embodiment of an FSIJIL print head constructed in accordance with the principles of the present invention.

DESCRIPTION OF THE PREFERRED EMBODIMENTS

Figure 2A:
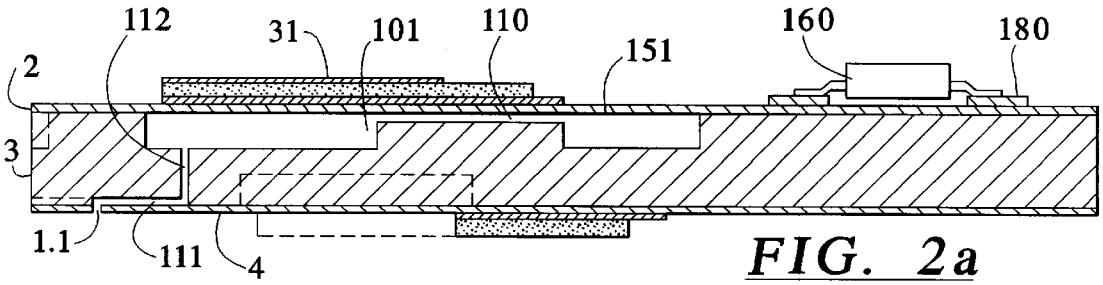
FIG. 2*a* is a section of the right half of a first embodiment of an FSIJIL print head constructed in accordance with the principles of the present invention, taken along line IIa—IIa of FIG. 2*c*.

FIGS. 1*a*–1*b* show a first embodiment of the inventive edge-shooterjet-In-line print head (ESIJIL print head), which can be implemented in an overall head assembly in place of the ESIJIL print disclosed in German OS 42 25 799, corresponding to co-pending U.S. Application Ser. No. 08/101,449 (Ink Jet Print Head and Method for its Manufacture, Thiel et al.) filed Aug. 2, 1993.

FIG. 1*a* shows a section through the ESIJIL print head of the invention along the line A–A'. The middle part 3 is a middle plate structured on both sides and arranged between two non-profiled membrane plates 2 and 4. PZT elements 31 are secured on the membrane plates. Interconnects 180 and further mechanical and/or electrical components or integrated circuits 160 are secured on the membrane plate 2. A first group of chambers 101 spaced from one another in the z-direction is arranged in a first plane of the middle part 3. A second group of chambers 105 spaced from one another in the z-direction is arranged in a third plane spaced below the first plate by a distance in the y-direction. A single nozzle row 1 for all nozzles lies in this third plane of the middle part 3.

The openings, channels, a suction space 150 and the chambers in the first plane are in communication with chambers or nozzle channels of the third plane of the middle part 3 via a second plane of the middle part 3. The single-piece middle part is thereby fashioned with ink channels that proceed perpendicularly through, and in a number of planes, such that an approximately identical ink path length exists for each channel. The chamber groups are arranged as rows of ink chambers and are offset relative to one another in the x, y and z directions (i.e. the chamber groups are non-concentric) such that all ink paths from the suction space 150 to the chambers, or from the chambers to the nozzles in the nozzle row, are of equal length, at least within one module.

The ink proceeds via leads and openings, as disclosed in the aforementioned co-pending application, into a suction space 151 that is in communication with the ink chambers 101 of the first plane via admission channels 110. The ink chambers are in communication, via through-channels 112 extending through the second plane and via channels 111, with the nozzles in the nozzle group 1.1 that are arranged in the third plane. Each ink chamber has a membrane and a PZT element allocated to it which, when charged with an electrical pulse, deforms the membrane and thus modifies the volume of the chamber. Given an expansion of the chamber volume, ink is supplied from the suction space 151. Given a compression of the chamber volume of a chamber 101 belonging to the first chamber group, the ink drops are ejected in the x-direction by a nozzle belonging to the nozzle group 1.1.

Further channels, openings, chambers, etc., which are not shown in FIG. 1*a*, are likewise arranged in the ESIJIL print head in order to supply the nozzles in the third plane with ink from the chambers in the third plane of the print head. The corresponding arrangement proceeds more clearly from a section Ib—Ib shown in FIG. 1*b*.

The ink through-channels 114—as shown in the section Ib—Ib—lead from the suction space 151 in the first plane through the second plane onto the admission channels 113. The ink proceeds via admission channels 113 having flow restrictors in the third plane to the ink chambers 105 of a further chamber group, and proceeds from the latter to the nozzles of the nozzle group 1.5 via nozzle channels 115.

The nozzles belonging to the nozzle groups 1.1 and 1.5 are arranged in a nozzle row 1 in the z-direction. For purposes of explanation, FIG. 1*d* shows a portion of an edge of the entire ESIJIL print head according to the first version having a corresponding nozzle arrangement of a nozzle row 1 with a superimposition of the sections C–C', D–D', E–E', and G–G'. The PZT elements are not shown, for clarity.

The nozzles of the nozzle groups alternate with nozzles of the other nozzle groups in the nozzle row. Nozzles in the nozzle groups 1.1 and 1.5 are individually connected to respective chambers 101 and 105 of the first and further chamber groups. The chambers 101 and 105 belonging to different groups are arranged offset vertically in the y-direction and are offset horizontally in the x-direction and in the z-direction.

FIG. 1*c* shows the position of the chambers in the first plane 2 of the ESIJIL print head in a plan view from the equipping side according to the arrangement of the first embodiment. The chambers lying therebelow in the third plane 4 are shown with broken lines in order to illustrate their position relative to the first chamber plane. The two chamber groups for chambers 101 and 105 are offset by an amount in the x-direction and are offset by the amount Z in the z-direction.

The nozzle row 1 contains nozzles belonging to different nozzle groups 1.1 and 1.5 which alternate such that overlapping of chamber groups in one plane with those of the other plane occurs only at the chamber edges. The overlapping area F of a chamber of the chamber group 105 with a chamber of the chamber group 101 is shown shaded. The overlapping area F can be minimized by the offsets in the x-direction and the z-direction.

In a preferred embodiment, photosensitive glass is employed as the material for all plates of the print head. The structuring, including the fashioning of the nozzles, is achieved by a photolithographic process and etching of the exposed parts.

Metal may also be used as plate material. The thicknesses of the membrane plates must be selected corresponding to the modulus of elasticity. The manufacture ensues by exposure of photoresist surfaces, etching and thermal bonding or gluing in a known way.

The advantages of this print head design are that the manufacture thereof is simpler and faster in many respects:

- Only two masks required, which need be aligned only within a certain range of tolerances.
- Only one of three plates must be structured, i.e., an elimination of two-thirds of the outlay for lithography and etching processes.
- The two cover plates can be identical, i.e. both can be made from the same wafer.
- The assembly of the three plates is completely uncritical since all function-defining structures are located on the middle plate.

These important advantages result in a marked reduction of the manufacturing costs.

The manufacturing method for the edge shooter and face shooter versions of the print head shall be set forth in greater detail with reference to the example of glass as material. A mask is placed onto a wafer of photosensitive glass. After exposure with UV-light, a phase conversion of amorphous material into its crystalline phase is effected at the exposed locations on the basis of a thermal treatment. Crystalline material can then be eroded layer-by-layer by etching, as disclosed in U.S. Pat. No. 4,092,166.

It is assumed that the exposure (preferably UV-light) in the photolithographic process is controlled in terms of intensity and duration. The depth of the modification of the material is thereby stopped when the corresponding plane is reached. The same is true, of course, for the back exposure. A through-exposure of the material is thereby avoided.

The exposures are undertaken with two masks that respectively produce the upper and lower structures. In order to avoid a through-exposure during the etching, etching can be undertaken from only one side by applying a mask over the opposite side of the plate before the etching process. The etched depth is defined by the concentration and the duration of the etching bath. Advantageously, an ultrasound immersion bath is employed. The differently etched depths can be produced by multi-stage etching, whereby the shallower structures are protected against further etching by masking. The vertical channels can also be manufactured in this way as a connection between the ink chambers placed at the underside and the nozzles structured at the upper side.

As proceeds from the front view (FIG. 1*d*), the ink chambers at the undersided overlap with those at the upper side in order to assure a high density of the nozzle arrangement. Valid are:

$$D=2a+b+2s\cdot D \quad (1)$$

$$(1-2s)\cdot D=2a+b \quad (2)$$

The selectivity s is the ratio of the etching rates between the unexposed part of the sensitive material and the exposed part, and lies between 2% and 5% given, for example, photosensitive glass.

The initial thickness D of the material of the middle plate is therefore selected such according to equation (3) so that it corresponds to twice the depth a of an ink chamber plus a minimum wall thickness b between the parallel bases of the overlapping ink chambers at both sides divided by the difference between one and twice the selectivity s of the etching process:

$$D=\frac{2a+b}{1-2s} \quad (3)$$

The two membrane plates (upper plate and lower plate) can be preferably have identical dimensions. Their thicknesses are selected such that an adequate modification of the chamber volume causing the ejection of an ink drop occurs on the basis on the modulus of elasticity, the width and length of the ink chambers and the bending force of the PZT. Material thicknesses from 0.05 mm through 0.2 mm are preferably employed. Commercially available plates of a five inch wafer having thicknesses of approximately 1 mm are initially detached from one another for the manufacture of the diaphragm plates and the individual diaphragms plates of the module are then etched to a thickness of approximately 0.1 mm after UV exposure. The module is thermally bonded after the mounting of the membrane plates 2 and 4 on the etched middle part 3. The application of the other elements follows thereupon in order to complete the module to form a print head.

Another manufacturing version proceeds using undetached middle and membrane plates that are lithographically etched to approximately 0.2 mm. Detachment into individual modules is undertaken only after the thermal bonding. Stacked PZTs are utilized as compression elements for the higher force effect now required because of the larger membrane thickness. The manufacture of such stacked PZTs can ensue in a way similar to that shown in FIG. 3 of European Application 443 628.

Figure 2B:
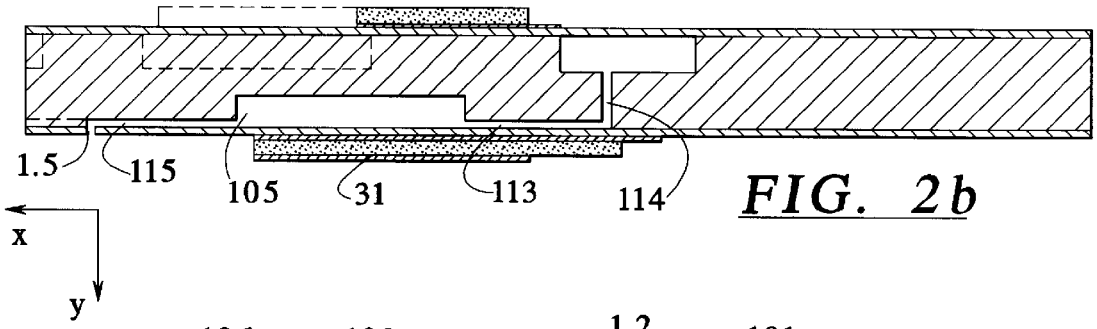
FIG. 2*b* is a section of the right half of the first embodiment of an FSIJIL print head constructed in accordance with the principles of the present invention, taken along line IIb—IIb of FIG. 2*c*.
Figure 2C:
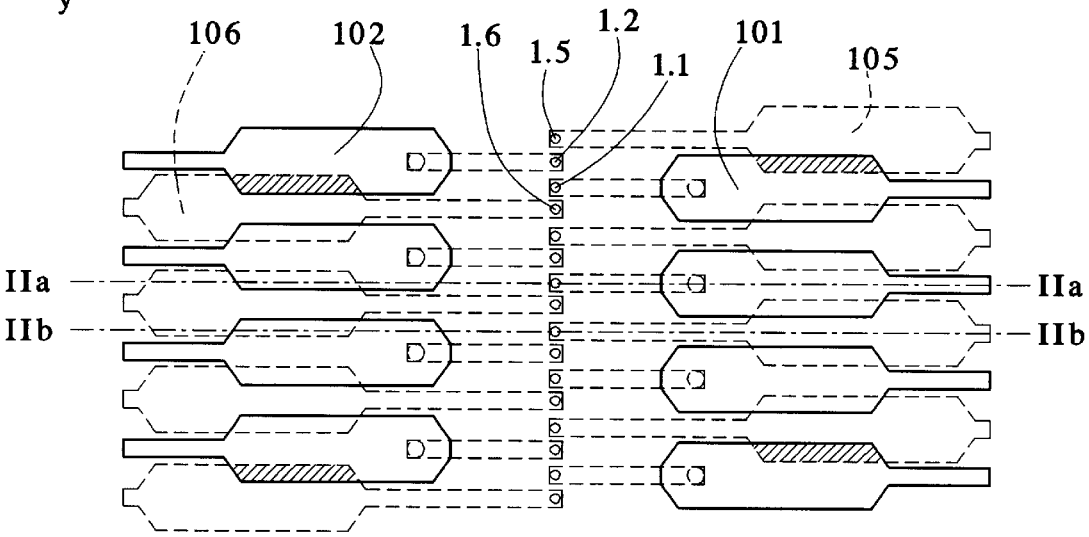
FIG. 2*c* is a plan view onto the middle plate (equipping side) showing the position of the chambers in the first embodiment of an FSIJIL print head constructed in accordance with the principles of the present invention.

FIGS. 2*a*–2*c* show a version according to which a face-shooter-ink-jet-in-line (FSIJIL) print head can be executed in place of the FSIJIL print head disclosed in pending German Patent Application P 43 36 416.0, corresponding to co-pending U.S. Application Ser. No. 08/229,585 (Face Shooter Ink Jet Printing Head and Method for the Manufacture Thereof, Thiel) filed Apr. 19, 1994.

FIG. 2*a* shows a section along the line IIa—IIa , and FIG. 2*b* shows the section along the line IIb—IIb of the FSIJIL print head according to a first embodiment. FIGS. 2*a* and 2*b* illustrate the ink guidance in the FSIJIL print head. The chambers for the nozzle row and for a suction space are again arranged such that ink channels, particularly nozzles channels and admission channels and through-channels of different length are provided in each plane, whereby the sum of all ink channel lengths in the x, y and z directions allocated to every chamber is approximately the same.

The other part of the inventive face-shooter ink-jet print head not shown in these sections contains further groups having chambers 102 and 106 at a second suction space 152 at the other side of the nozzle row. In a plan view (equipping side), FIG. 2*c* illustrates the position of the chambers 101, 102, 105 and 106 belonging to various groups, which are offset relative to one another in the proximity of the nozzle row. Compared to an edge-shooter ink jet print head, thus, twice the nozzle density is achieved. The membrane plate 4, however, must now also be fashioned as a nozzle plate. This advantageously is accomplished by subsequent laser beam processing. Some other manufacturing steps in this embodiment, before the thermal bonding, require an exact alignment of components or masks.

The nozzles 1 and through-channels 112 and 114 can be manufactured in various ways. Thus, they can be etched, burned through with a laser beam or punched with special tools. The selection of the method depends, among other things, on the material employed.

A corresponding process management is required when etching the membranes. The thickness of the membrane layer is monitored during etching and the thickness of the membrane required at the end of the manufacture of the chambers is achieved for the chambers by fine-grinding each of the chamber parts.

Etchants having different concentrations and/or having different bite times are utilized for the three regions in order to be able to remove the corresponding regions with differing depth precision, whereby the depth precision when etching the regions for through-bores is lower than when etching extremely shallow regions for the channels in the chamber planes. The through-bores are etched first, followed by the chambers and then followed by the nozzle channels. One can also proceed vice versa given corresponding masking.

Uniform and joining of the three plates, 2, 3 and 4 is produced by thermal diffusion bonding. Interconnects are glued on or sputtered on.

Figure 2D:
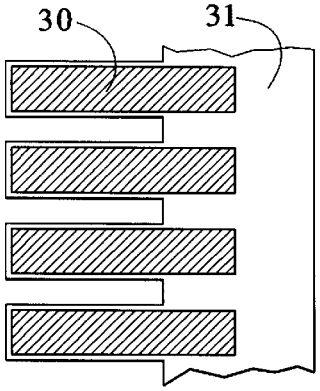
FIG. 2*d* is a view of a PZT plate for the first embodiment of an FSIJIL print head constructed in accordance with the principles of the present invention.

FIG. 2*d* shows a view of a PZT plate 31 that is secured on the membrane plate whereby the positioning outlay can be reduced compared to individual elements. The individual PZT elements are produced comb-like and are provided with electrodes 30.

The application of PZT elements can ensue by respectively metallizing first and second pre-treated PZT plates, which are then respectively applied onto the first and second membrane plates. If the PZT elements have not yet been adequately worked on the plate, a plurality of individual PZT elements can be subsequently separated for each side of the module.

Assembly to form a print head in the manufacturing method can advantageously ensue in the following way:

Nozzle cleaning with compressed air.

Treatment (cleaning and rinsing) of the chambers in nozzles. A hydrophilic inside coating arises by rinsing with a first, suitable, commercially obtainable liquid.

A hydrophobic outside coating is achieved by treating the print side of the plate comprising the nozzles with a second, suitable liquid. The nozzles are finished after the hardening of the upper layer.

Providing a module with the required driver circuits on that side of the module orthogonal relative to the printing side and, if necessary, providing the module with a protective housing.

Combining the module with further, different means required for the operation thereof (electrical, mechanical and ink supply means).

The print head is subsequently accommodated in a housing before it is tested for functionability in order to eliminate faulty units.

Lastly, a test of the completely finished print head also ensues.

Figure 3A:
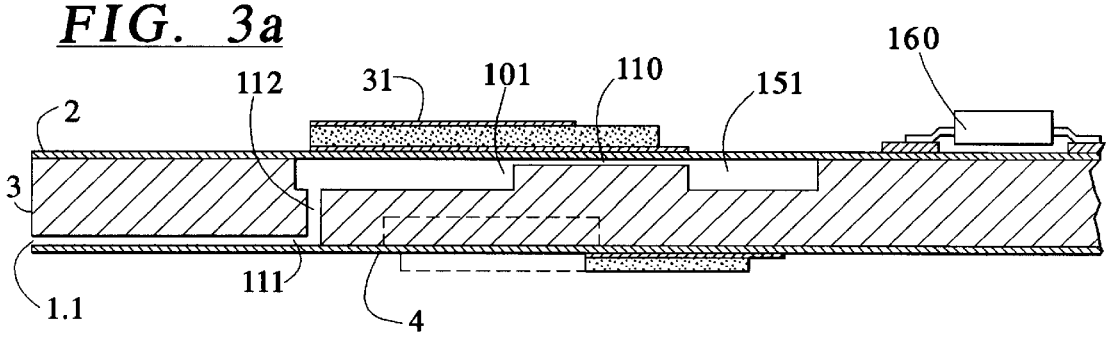
FIG. 3*a* is a section of a second embodiment of an ESIJIL print head constructed in accordance with the principles of the present invention, taken along line IIa—IIa of FIG. 3*c*.
Figure 3B:
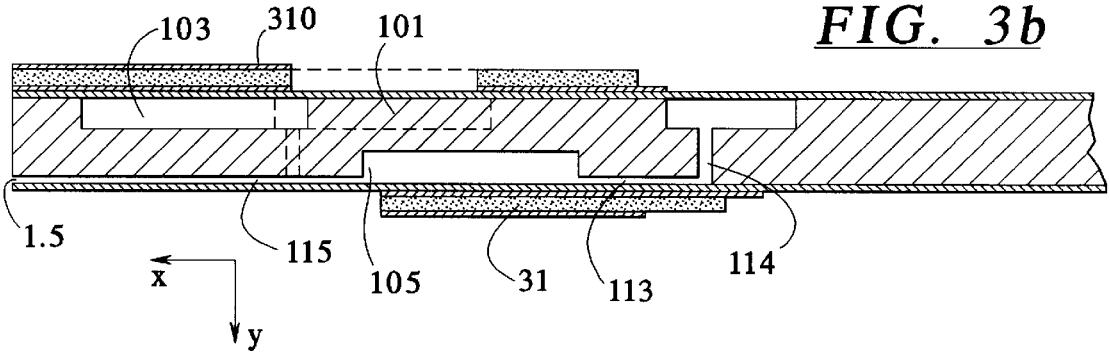
FIG. 3*b* is a section of the firs embodiment of an ESIJIL print head constructed in accordance with the principles of the present invention, taken along the line IIb—IIb of FIG. 3*c*.
Figure 3B:
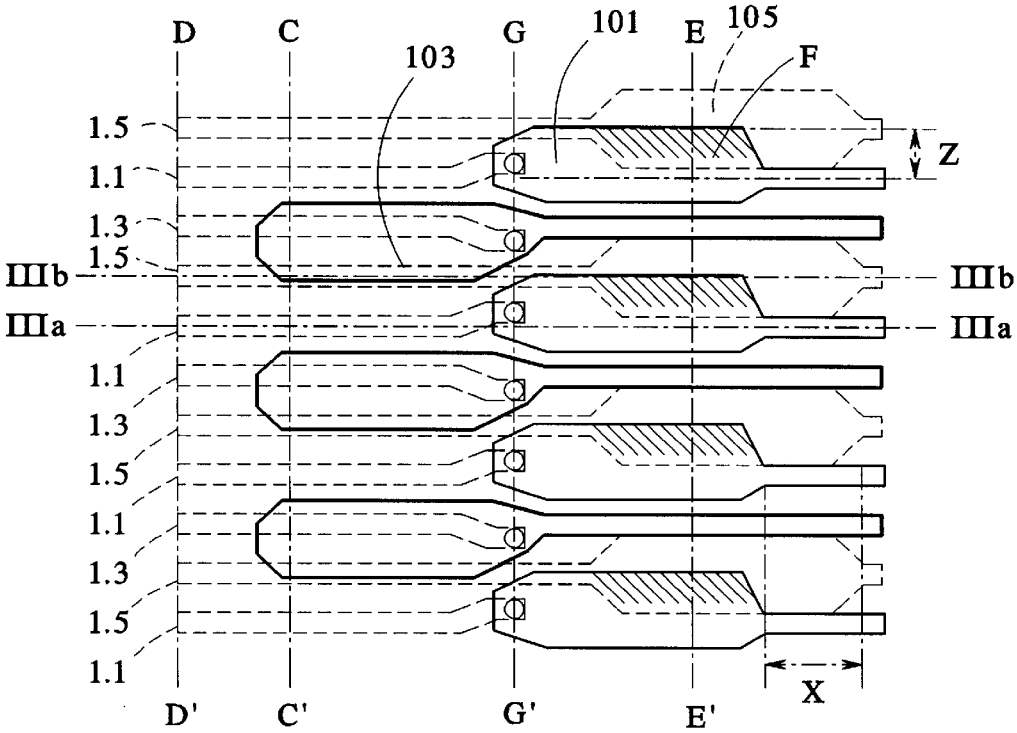
Figure 3C:
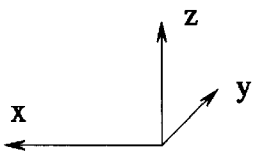
FIG. 3*c* is a plan view onto the middle plate (equipping side) showing the position of the chambers in the second embodiment of an ESIJIL print head constructed in accordance with the principles of the present invention.

The second embodiment of an ESIJIL print head having enhanced resolution is shown in FIGS. 3*a*–3*c*. FIG. 3*a* shows a section along the line IIIa—IIIa ,; FIG. 3*b* shows a section along the line IIIb—IIIb; and FIG. 3*c* shows a plan view onto the middle plate (equipping side) of the ESIJIL print head according to this second embodiment.

The arrangement of the chambers 103 of an additional chamber group between the chambers 101 of the first chamber group and the nozzle line D–D' is shown in the plan view onto the middle plate (equipping side) in FIG. 3*c*. It is clear from the section IIIb—IIIb in FIG. 3*b* that an ink paths of equal length arise, as in the case of the ink paths with respect to the chambers 101 or 105 belonging to the other chamber groups. This additional chamber group is preferably supplied from the same suction space 151.

A face-shooter-ink-jet print head having higher nozzle density can be analogously constructed. FIG. 4*a* shows a section along the line IVa—IVa, through such an FSIJIL print head according to the second embodiment. The chamber 101 of a first chamber group is arranged at one side to the right of the nozzle line 1 in communication, via a through-ink channel 112 and via a nozzle channel 111 in the third plane of the middle part, with the nozzle belonging to the nozzle group 121.

At the other side to the left of the nozzle line, a further chamber group is arranged close to the nozzle side, and the chamber 104 of an additional chamber group is arranged close to the equipping side. The chamber 104 is in communication with a nozzle (not shown) belonging to the nozzle group 1.4 and neighboring the nozzle belonging to the nozzle group 1.1. This communication takes place via an ink through-channel 112 (shown with broken lines) and nozzle channels in the third plane of the middle part 3.

Only the nozzle belonging to the nozzle group 1.5 that is supplied from the chamber 105 is shown, by contrast, in the section along the line IVb—IVb of the FSIJIL print head according to the second embodiment. Nozzles which belong to the nozzle group 1.2 and 1.6 neighbor this nozzle. The corresponding ink paths from the chambers 102 and 106 of the chamber groups lying to the left of the nozzle line are shown in broken lines up to the appertaining nozzles. The chamber 103 belonging to the additional chamber group lies to the right of the nozzle line and is in communication with the nozzle (not shown) belonging to the nozzle group 1.3 via channels.

The position of the additional chambers 103 to the right and 104 to the left of the nozzle line may be seen from FIG. 4*c* which shows the FSIJIL print head of the second embodiment in a plan view onto the middle (equipping side). These chambers are in turn respectively arranged in groups that are also offset relative to one another in the z-direction. Just as the nozzle groups 1.1 through 1.6 alternate relative to one another within the nozzle row 1, all chamber groups have an offset in the z-direction.

Figure 5A:
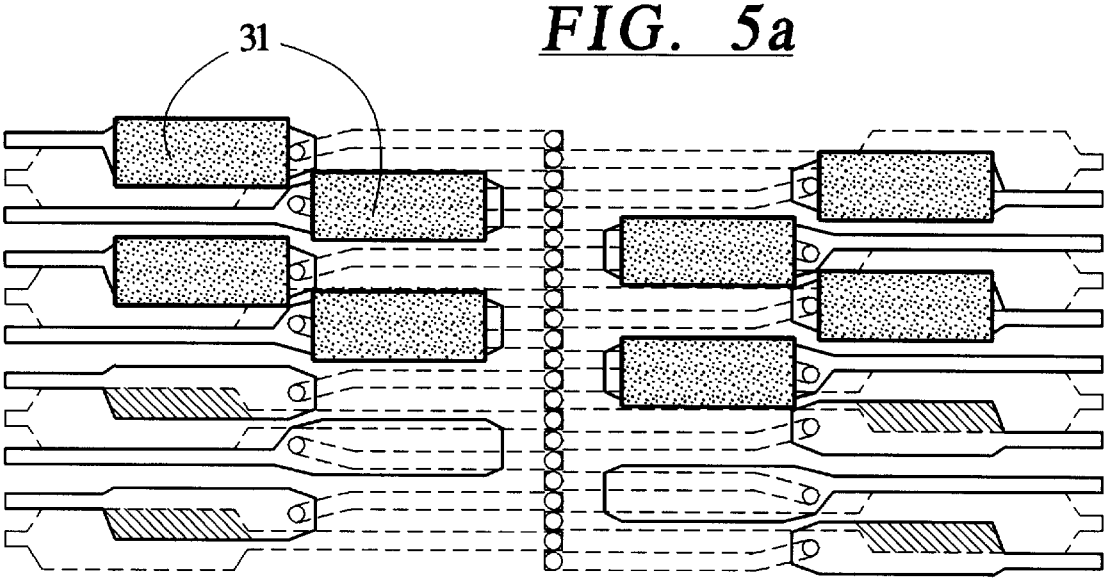
FIG. 5*a* shows the arrangement of PZT elements on a membrane plate.

This offset, which requires a certain positioning and adjustment outlay, proceeds from the arrangement of the PZT elements on the membrane plate 2 shown in FIG. 5*a*.

Figure 5B:
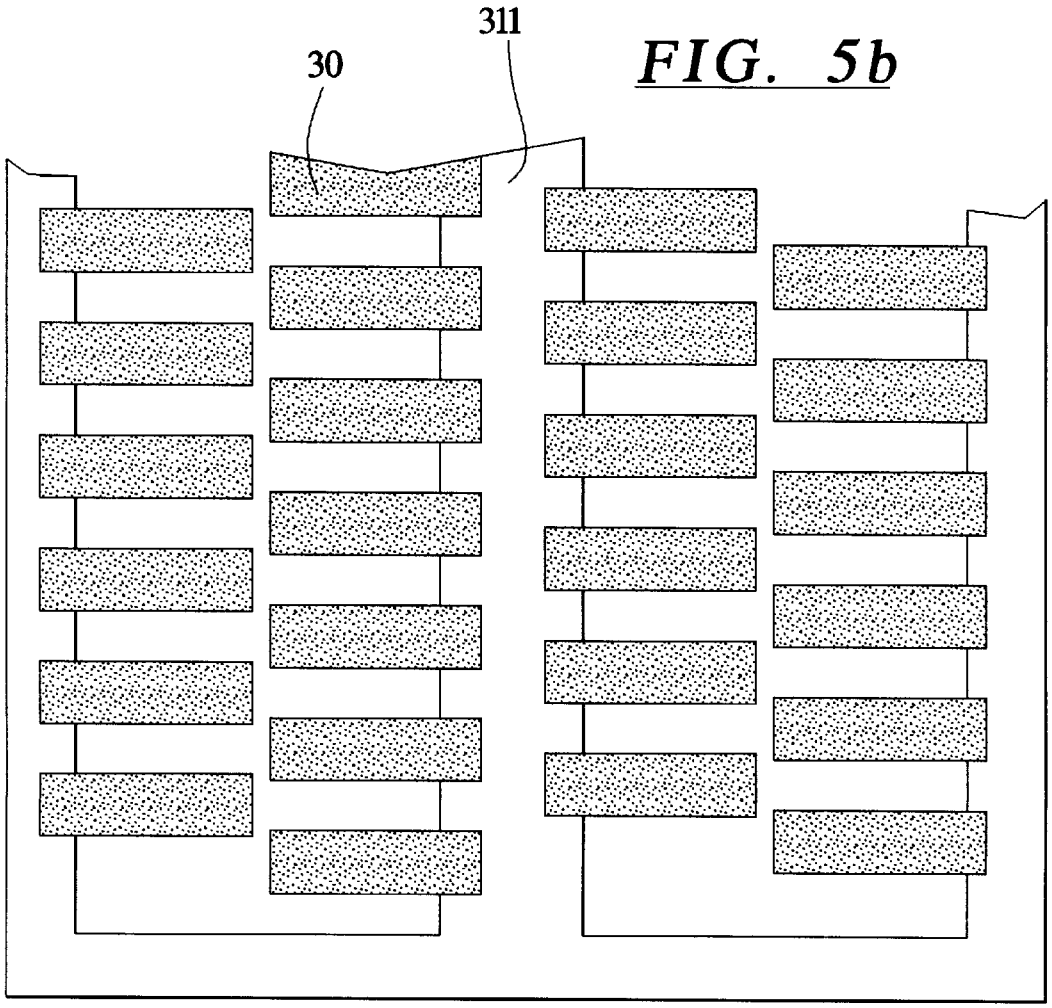
FIG. 5*b* is a view of a PZT plate for the second embodiment of an FSIJIL print head constructed in accordance with the principles of the present invention.

This adjustment outlay can be substantially reduced when a prefabricated PZT plate 311 as shown in FIG. 5*b* is utilized. The multiple comb structure of the PZT plate allows a one-time positioning on the membrane plate over the corresponding chambers with little outlay. The PZT plate is structured by etching after a conventional photolithographic process. The electrode coating 30 of the PZT plate 311 is applied by sputtering and is electrolytically reinforced.

The embodiment for ESIJIL print heads according to FIG. 3 or for FSIJIL print heads according to FIG. 4 can be modified by omitting the chamber group 101, or the chamber groups 101 and 102. One group of nozzle channels and one chamber group 105 and 106 can be arranged on one surface of the middle part, and a further chamber group 103 and 104 spaced from the nozzle row in the x and y directions can be arranged on the other surface between the nozzle row 1 and a row which the chambers form with the through channels 112 that connect the nozzle channels.

In a further version, the influence of a greater offset of ink chamber groups relative to one another on the printed format can be compensated by structural (ink channel cross-section) and/or electronic measures without the ink path length having to be exactly equal. The different structures on the two opposite surfaces of the middle part 3 allow a relatively close positioning of the nozzle row 1 to one of the two structures. The ink path from the chamber to the nozzles, or from the intake spaces 151 and 152 to the chambers, is then different for the structures that are offset relative to one another and lie opposite one another. A greater offset of the ink chamber groups relative to one another in the x-z plane can be achieved in exchange therefor, the cross-talk being thereby more greatly suppressed than if it were mainly the spacing of the structures in the y-direction that were increased, i.e., the thickness of the middle plate 3.

The invention is not limited to the disclosed embodiments. On the contrary, a number of modifications are conceivable that make use of the illustrated solution even given embodiments of a fundamentally different nature. Accordingly, although modifications and changes may be suggested by those skilled in the art, it is the intention of the inventor to embody within the patent warranted hereon all changes and modifications as reasonably and properly come within the scope of his contribution to the art.

I claim as my invention:

1. An ink jet print head comprising:

a middle part having opposite surfaces and a single nozzle row including a first group of nozzles and a second group of nozzles, said opposite surfaces having respective, different structures worked thereon, a first of said structures having parallel nozzle channels respectively leading to nozzles in said first group of nozzles and said second group of nozzles in said single nozzle row, each of said different structures having recesses forming a group of non-concentric ink chambers in said different structures being respectively offset from each other in mutually orthogonal x, y and z directions of a Cartesian coordinate system, the ink chambers in said first of said structures being respectively directly connected to said first group of nozzles by said respective nozzle channels, and said ink chambers in said second of said structures being respectively connected to nozzles in a second group of nozzles in said single nozzle row by said respective nozzle channels and respective channels extending through said middle part between said first structure and said second structure to said respective nozzle channels; and outer, non-profiled membrane plates respectively disposed on said opposite surfaces of said middle part and covering said different structures on said opposite surfaces.

2. An ink jet print head as claimed in claim 1 wherein said ink chambers are offset from each other in the x-direction, the y-direction and the z-direction so that respective ink chambers in said different structures overlap at most only at edges of said ink chamber.

3. An ink jet print head as claimed in claim 1 wherein said first of said different structures includes a further plurality of non-concentric chambers forming a further chamber group in said first of said structures, with said chamber group and said further chamber group in said first of said structures being offset in the x-direction and the z-direction.

4. An ink jet print head as claimed in claim 3 wherein said channels extending through said middle part form a row and wherein the respective chambers forming said further chamber group on said first of said surfaces of said middle part are spaced from said single nozzle row in the x-direction and the y-direction and are disposed between said single nozzle row and said row of channels extending through said middle part.

5. An ink jet print head as claimed in claim 1 wherein said first group and said second group of nozzles in said single nozzle row are disposed in a plane. defined by said x-direction and said y-direction, of said middle part containing said nozzle channels, with nozzles respectively in said first and second groups alternating in said single nozzle row.

6. An ink jet print head as claimed in claim 1 wherein said first group and said second group of nozzles in said single nozzle row are oriented for ejecting ink in the y-direction through one of said outer membrane plates, with nozzles respectively in said first and second groups alternating in said single nozzle row.

7. An ink jet print head as claimed in claim 1 wherein each of said different structures on said opposite surfaces includes recesses forming non-concentric ink chambers in a further chamber group on each of said surfaces , with all of the chamber groups on both of said different surfaces being spaced from each other in the x-direction, the y-direction and the z-direction, and with the chamber group and the further chamber group on each surface being spaced from each other in the x-direction and the z-direction.

8. An ink jet print head as claimed in claim 1 wherein said middle part comprises a plurality of vertical and horizontal ink channels respectively communicating with said different structures on said opposite surfaces for producing a plurality of ink paths each an identical length and respectively extending between the chambers and the first group and the second group of nozzles in the single nozzle row.

9. An ink jet print head as claimed in claim 1 wherein said groups of ink chambers respectively in said different structures are offset in the x-direction so that the nozzle channels connecting the chambers in each of said different structures have identical lengths.

* * * * *